US005193561A

United States Patent [19]

Robb et al.

[11] Patent Number: 5,193,561

[45] Date of Patent: Mar. 16, 1993

[54] APPARATUS HAVING A FLUID TIMER FOR CLEANING PAINT FROM OBJECTS

[75] Inventors: Richard A. Robb; Lee S. Garretson, both of West Bloomfield; Michael J. Grubb, Union Lake, all of Mich.

[73] Assignee: Herkules Equipment Company, Walled lake, Mich.

[21] Appl. No.: 619,941

[22] Filed: Nov. 29, 1990

[51] Int. Cl.[5] ..... B08B 3/02

[52] U.S. Cl. ..... 134/57 R; 134/58 R; 134/169 C; 134/102.1; 134/200; 134/166 C

[58] Field of Search ..... 134/57 R, 56 R, 166 C, 134/169 C, 95, 102, 200, 58 R; 68/12.11, 207; 137/624.11, 624.13, 624.14; 251/553

[56] References Cited

U.S. PATENT DOCUMENTS

| | | | |
|---|---|---|---|
| Re. 30,097 | 9/1979 | Gillespie | 68/207 X |
| 1,775,293 | 9/1930 | Pfening et al. | 68/207 X |
| 2,628,487 | 2/1953 | Branson | 68/12.11 |
| 2,973,781 | 3/1961 | Cadella | 137/553 |
| 3,526,237 | 9/1970 | Neill, Jr. | 134/58 R |
| 3,931,832 | 1/1976 | Hodler et al. | 137/624.11 |
| 4,106,670 | 8/1978 | Takeda | 137/624.11 X |
| 4,182,371 | 1/1980 | Moore | 137/624.11 |
| 4,280,530 | 7/1981 | Yi | 137/624.11 |
| 4,651,907 | 3/1987 | Thomas | 137/624.11 X |
| 4,785,836 | 11/1988 | Yamamoto | 134/56 R |
| 4,899,769 | 2/1990 | Tsai | 134/200 X |
| 4,925,495 | 5/1990 | Crisp et al. | 134/56 R X |
| 5,027,841 | 7/1991 | Breunsbach et al. | 134/200 |

*Primary Examiner*—Frankie L. Stinson

[57] ABSTRACT

An apparatus comprising: a work chamber (14) in which may be placed an object to be cleaned, and a cover (32) to enclose the work chamber; a fluid delivery system (52, 54) for delivering cleaning solvent to the work chamber (14) including a pump (40) for pressurizing the solvent; a first and second switch (204,210) for activiating and deactivating the operation of the pump means; and a fluid timer (220), in communication with the fluid delivery system, for causing at least one switch to be activated and thereafter after a predetermined time deactived terminating operation of the pump.

27 Claims, 14 Drawing Sheets

APPARATUS HAVING A FLUID TIMER FOR CLEANING PAINT FROM OBJECTS

BACKGROUND AND SUMMARY OF THE INVENTION

The present invention relates to a system for automatically cleaning objects and includes fluid timer for automatically terminating the cleaning period after a predetermined time.

U.S. Pat. No. 4,793,369 illustrates one system for the cleaning paint from a paint spray gun and associated parts. U.S. Pat. No. 4,785,836 illustrates another system for cleaning paint guns and the like and includes a timer in an air delivery line to terminate the operation of the system.

The present invention provides a means for automatically and thoroughly cleaning residue, dirt, paint, etc. from surfaces and passages of a variety of articles. Cleaning is accomplished in a reliable, fast and inexpensive manner and incorporates a fluid timer positioned in communication with a portion of the fluid delivery system used to transport cleaning solvent to the parts to be cleaned.

It is an object of the present invention to automatically clean articles by introducing pressurized fluid such as cleaning solvent into a work chamber and to automatically terminate the operation of the system after a predetermined time period by use of a timing device in a fluid delivery line.

Accordingly, the invention comprises: an apparatus having a work chamber in which may be placed an object or objects to be cleaned, a cover to enclose the work chamber, a fluid delivery system for delivering cleaning solvent to the work chamber and for distributing the solvent in a manner to clean the object(s), a pump for pressurizing the solvent; switch means having an active state to enable the activation of the pump and a second state to disable the operation of the pump; and fluid timer means, in communication with the fluid delivery system, for causing the switch means to be placed in a deactive state after a Predetermined time period thereby automatically terminating the operation of the pump. The switch may be in either the air or fluid line. Various other alternate embodiments of the invention are also shown.

Many other objects and purposes of the invention will be clear from the following detailed description of the drawings.

DETAILED DESCRIPTION OF THE DRAWINGS

Figure 1:
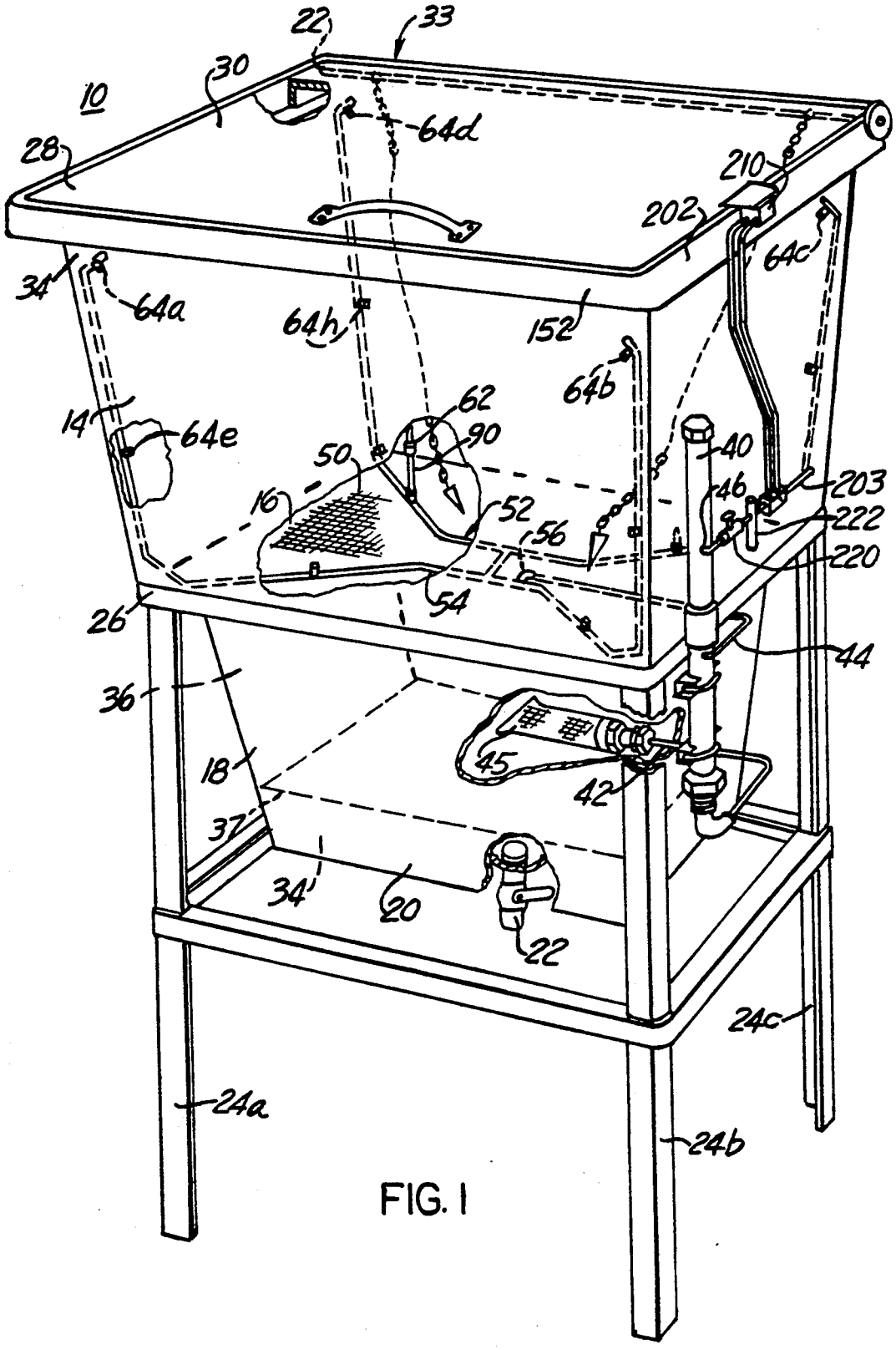
FIG. 1 illustrates the preferred embodiment of a cleaning system which may incorporate the present invention.
Figure 2:
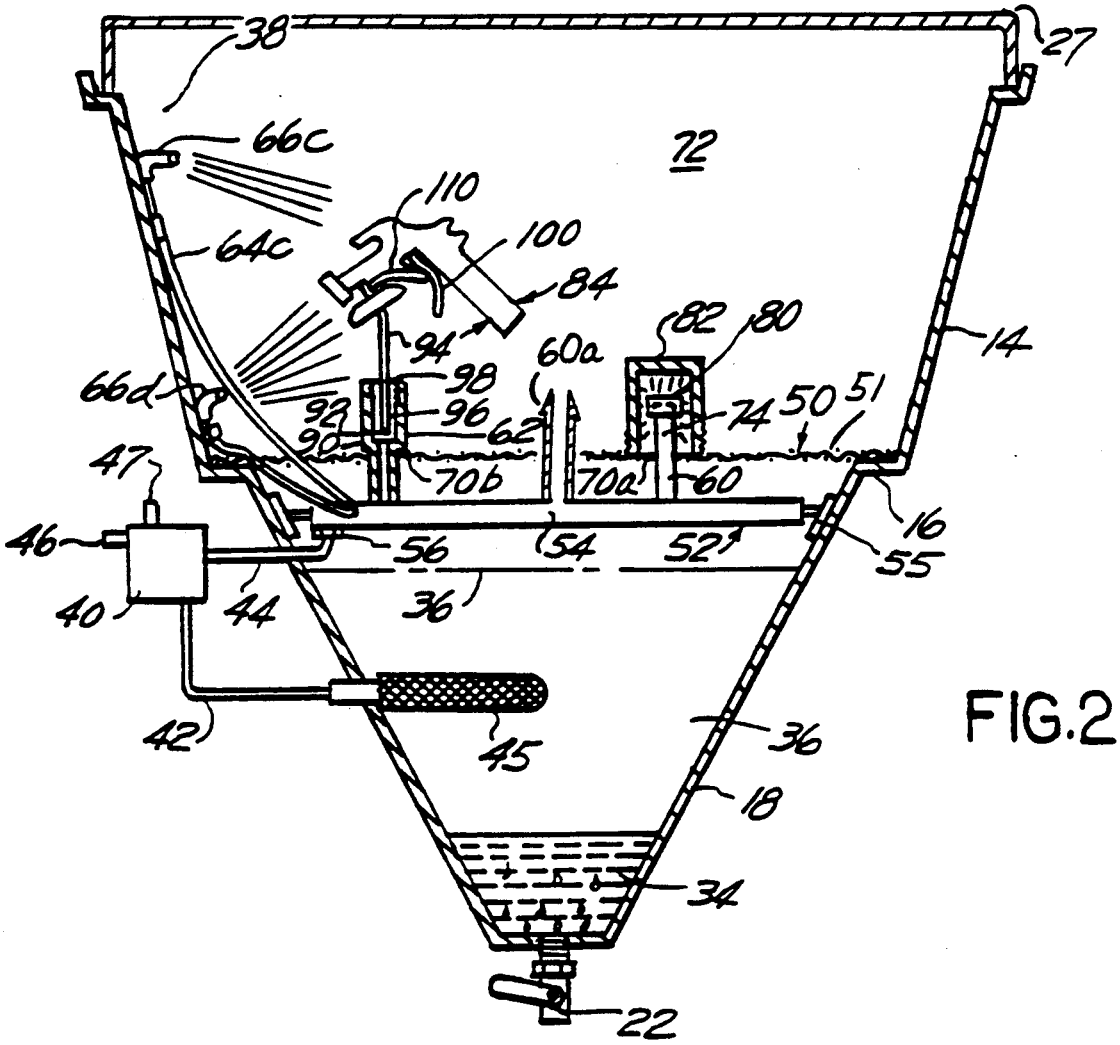
FIG. 2 is a view of a work chamber and a fluid storage chamber in communication with each other and also illustrates many of the major components of the cleaning system.

Reference is now made to FIGS. 1 and 2 which illustrate various views of cleaning system 10. The system 10 comprises a work chamber, generally designated as 14 in communication with a liquid chamber or reservoir generally designated as 18. It should be appreciated that the chambers shown are examplary and that they can be of many different configurations and shapes which are physically connected or remote from one another.

The liquid chamber 18 terminates at a bottom 20 having a drain valve 22. The work chamber 14 may be supported by a plurality of supports or legs 24*a–d*. A support or frame 26 engages a shoulder 16 formed between the chambers 14 and 18. Fitted to a top shoulder 28 is a cover 30 hinged at 32 to the work chamber housing 34. A small amount of water, generally shown as 34, is inserted into the chamber 18. Above the water is located a volume of paint solvent 36, the line of separation is diagrammatically shown as 37. It should be appreciated that as used herein paint solvent or cleaning agent is used generically and may be lacquer thinner, water, methyl-ethyl-ketone or the like depending of course on the type of paint to be cleaned. Water 34 having a higher specific gravity than the paint solvent 36 will tend to the bottom of the chamber 18 where it and any dislodged paint, dirt or residue, etc., can be periodically removed by opening the drain valve. Upon removal of the water 34 and dislodged paint, residue, etc. additional water and solvent, if needed, can be added. Secured to the support 26 or work chamber housing 34 is a pump 40. The pump 40 includes an inlet 42 in communication with a filter 45 disposed in the solvent 36 and an outlet 44 situated above the solvent 36 or in fluid communication with the work chamber 14. The outlet 44 is connected to a manifold assembly 52. The pump 40 further includes an air inlet 46 adapted to receive pressurized air from a source such as a compressor or the like. Depending upon the nature of the solvent an electrical pump can be employed which is controlled by an electric controller (not shown).

Reference is now made to FIG. 2 which is a cross-sectional view of the chambers 14 and 18 and illustrates many of the major features of the system 10. Situated above the solvent 36 and supported upon the shoulder 16 is a divider 50. The divider 50 may be formed by a wire mesh or other suitable foraminous material or formed by a plate (as shown) permitting gravity flow for draining liquid from the work chamber 14 to the liquid chamber 18. The divider 50 divides the work chamber 14 from the liquid chamber 18 and also defines a surface 51 for supporting various parts to be cleaned. Positioned below the divider 50 is the manifold assembly 52, comprising a manifold 54, secured by brackets 55 or other equivalent mounting means or simply laid upon the shoulder 16. The manifold assembly 52 is connected to the pump outlet 44 at 56. A plurality of outlets 60 and 62 also shown in FIG. 1 extend through the divider 50 into the work chamber 14. By way of illustration a cup 82 of a spray gun 84 may be positioned on the divider 50 in an inverted manner about a spray head 80 to receive the solvent 36. Another manifold outlet such as outlet 63 comprising another tube 90 is used to support the spray gun 84. The spray gun 84 illustrated in FIG. 2 is of the syphon type and its inlet comprises a syphon tube 94 which is supported on the tube 90. One of the outlets may be tapered see 62 to fit into the syphon tube 94 of the spray gun. Alternately, the outlet may have an enlarged bore 98 into which the syphon tube can be placed. Threads 96 may be provided proximate the open end 98 of the outlet 63 for receiving an adaptor used in conjunction with the gravity type spray gun as shown in U.S. Pat. No. 4,785,836 which is incorporated herein by reference.

The manifold assembly 52 further includes additional outlets 64*a–h* for spraying liquid about the work chamber 14. These outlets are typically located proximate the inner corners of the work chamber 14 or otherwise located thereabout for the specific cleaning task. These outlets 64 include a spray nozzle which is oriented to spray solvent upon the exposed portions of the objects to be cleaned. As can be seen the pump, manifold assembly, and outlets provide a fluid transport mechanism for transposting fluid or solvent from a reservoir to a work chamber.

Figure 3:
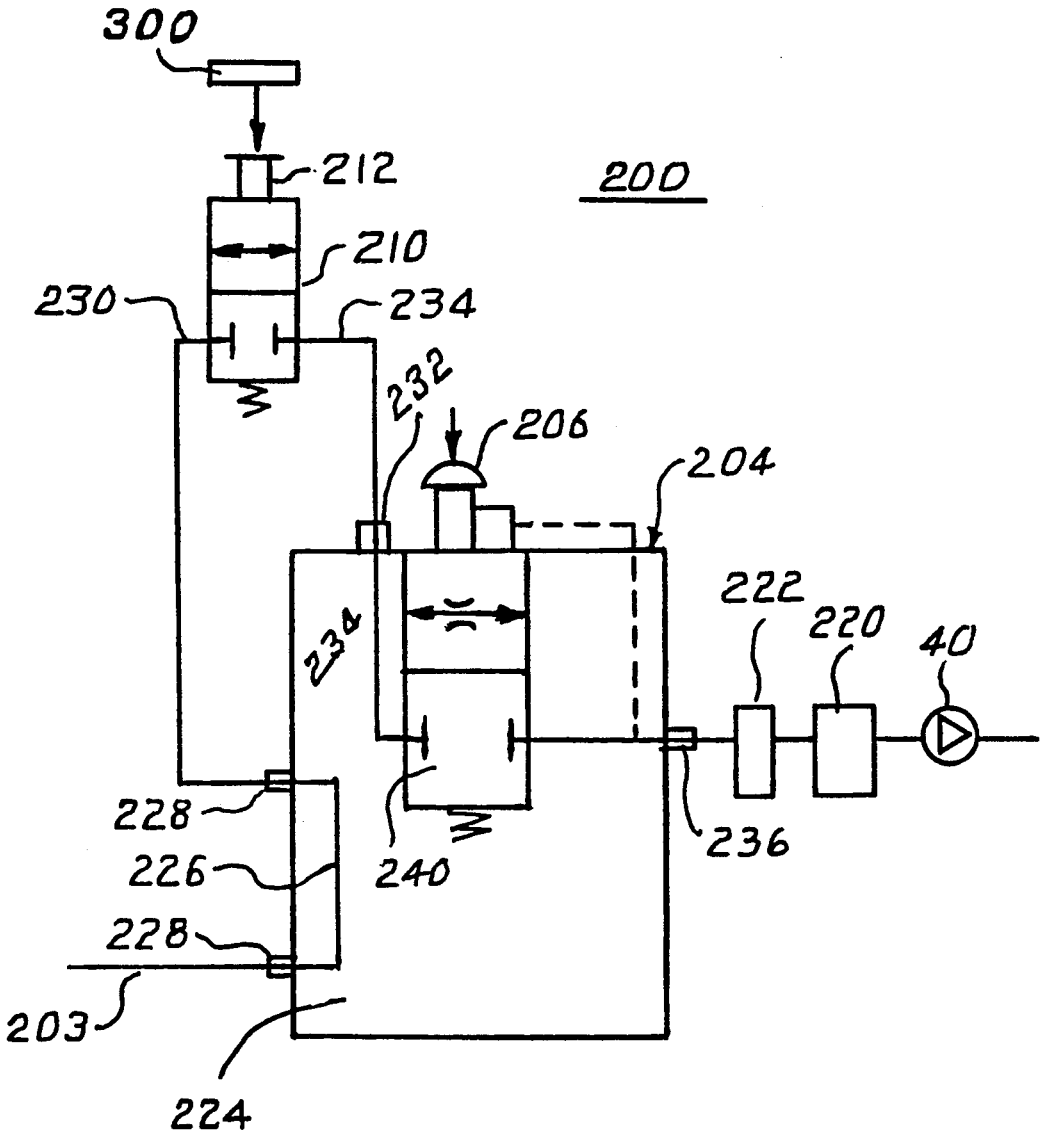
FIG. 3 diagrammatically illustrates various air switches used in the present invention.

The system 10 includes an air delivery system 200 shown in FIG. 1 and diagrammatically in FIG. 3. The air delivery system comprising a reset valve 204, a cut-off valve 210 connected to the reset valve 204. The cut-off valve 210 is mounted to interact with the cover 30 or part attached thereto. As shown in FIG. 1 the cut-off valve 210 is attached to a lip 202 of the work chamber 14 and the reset valve 204 is mounted external to the work chamber and connected to the pump 40. As can be appreciated many other mounting locations can be used. The reset valve 204 and cut-off valve 210 are known in the art and are only shown by schematic diagrams in FIG. 3. Positioned in series with the reset valve 204 is a filter/regulator 222, a needle (closure) valve 220 which is connected to the inlet 46 of the pump 40. Pressurized air is communicated to the reset valve 204 which provides for a convenient air feed through to the cut-off valve 210. In practice compressed air is operatively communicated first to the cut-off valve 210 which operates as an on-off switch and then to the operative parts of the reset valve 210. The purpose of the cut-off valve 210 and reset valve 204 are to selectively control the flow of compressed air to the pump and to protect the operator of the system. As will be seen from the discussion below the cut-off valve 210 is activated or deactived by a fluid timer element which is mounted to the cover 32. In this manner whenever the cover 32 is lifted by the operator further operation of the system is prohibited. The reset valve 204 provides an additional safety feature which prevents premature startup of the system, that is, until the operator takes a purposeful step to activate a manual reset button/-plunger 206 of the reset valve 204.

As can be seen in FIG. 3 the housing 224 of the reset valve accommodates a passage 226 sized to receive a standard ¼ inch air fitting 228 so that the operator can easily connect an air inlet tube 203 (which extends from the compressor) without any special hardware. As is known in the art, air compressors are often supplied with such ¼ inch connectors. The other end of passage 226 is fitted with a smaller diameter or instrument air type fitting 228 for connection to the inlet 230 of the cut-off valve 210. The reset valve housing 224 further includes another instrument fitting 232 and passage 234 to connect the outlet 234 of the cut-off valve 210 to the operative inlet 232 of the reset valve 204. An outlet fitting 236 of standard size is provided to facilitate connection to other components of the system such as the filter 222 or needle valve 220. The operative parts of the reset valve 204 include the manually activated plunger 206 operatively connected to a spring loaded spool valve 240. As mentioned above the plunger 206 is used to reinitialize the reset valve to reinstitute air flow after the cut-off valve 210 has been deactivated.

The cut-off switch 210 includes a spring loaded element 212 movable between a lowered (active) and a raised (off) position to control air flow through internal passages thereof in a known manner. The interruption of air flow through the cut-off valve 210 for any reason terminates the flow of compressed air to the reset valve 204 and hence the operation of the pump 40. When the switch element 212 is lowered to its active position (such as by a fluid timer cooperating element 300, also movable with the cover) compressed air is communicated through the reset valve 204 from the cut-off valve 210. If it is desired to restart the system the reset valve's plunger 206 is manually depressed, pressurized air then flows through the reset valve 204 and creates a force on the spring loaded internal spool valve 240 maintaining same in an activated position and permits air flow to the pump 40. With compressed air supplied to the pump 40 solvent is pumped throughout the system. When the cut-off switch element 212 has been moved to its raised or deactivated position such a by opening the cover 32 or disengagement by the element 300 air flow back to the reset valve is terminated. With air flow terminated the spring loaded spool valve 240 moves to its deactivated position to further block communication of pressurized air to the pump 40.

Figure 4:
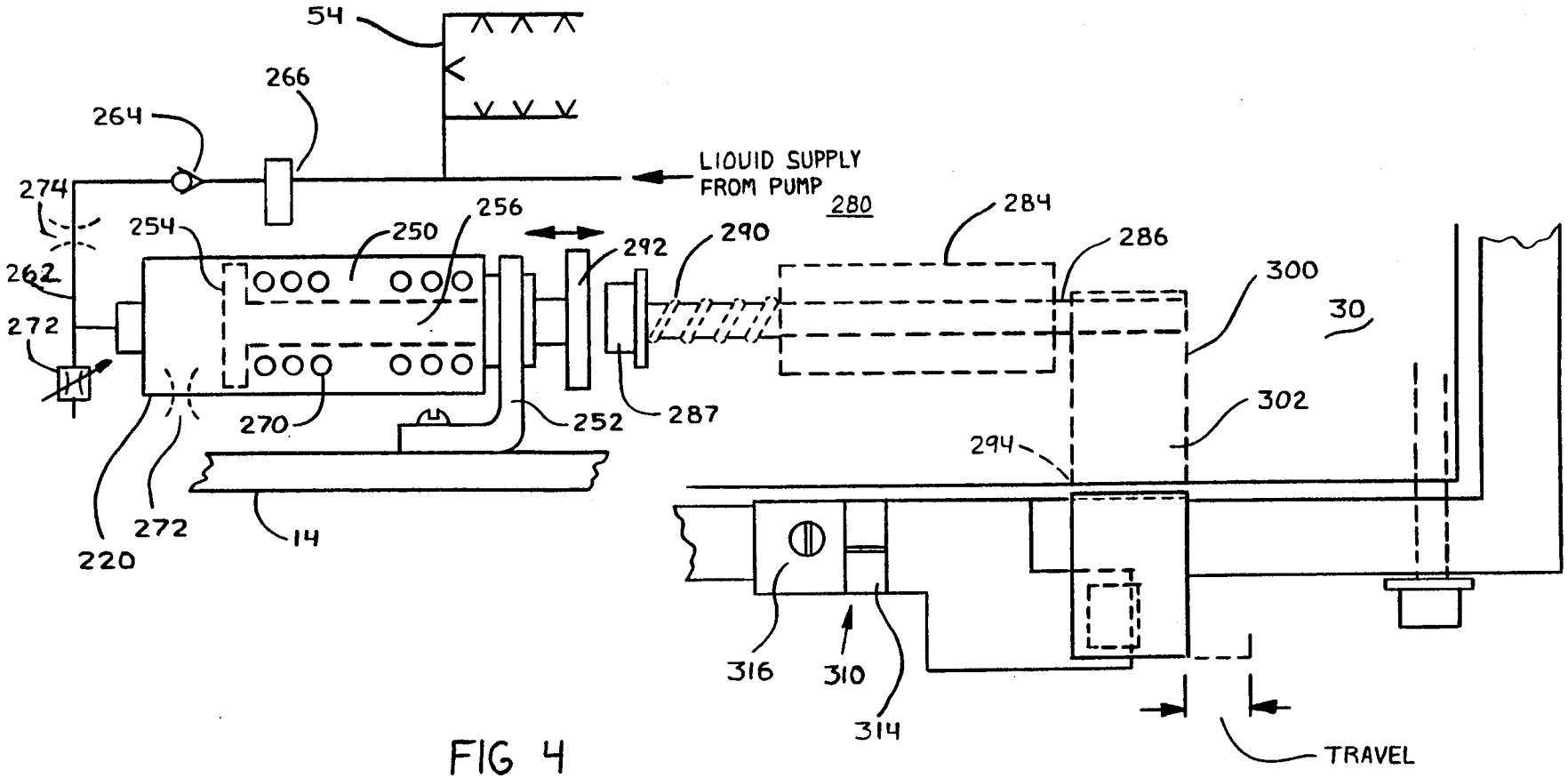
FIGS. 4, 5 and 6 illustrate various view of fluid timer.
Figure 5:
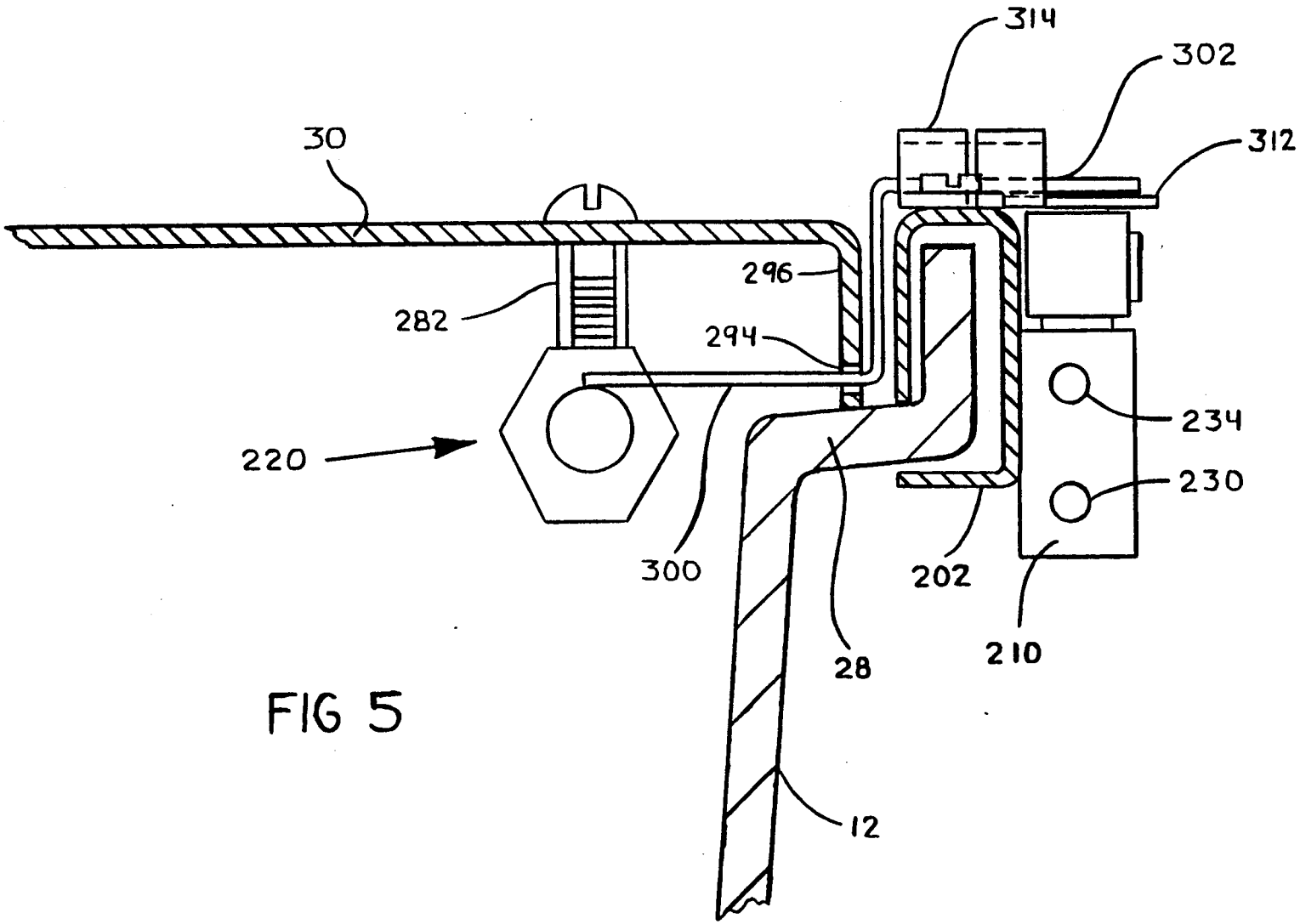
Figure 6:
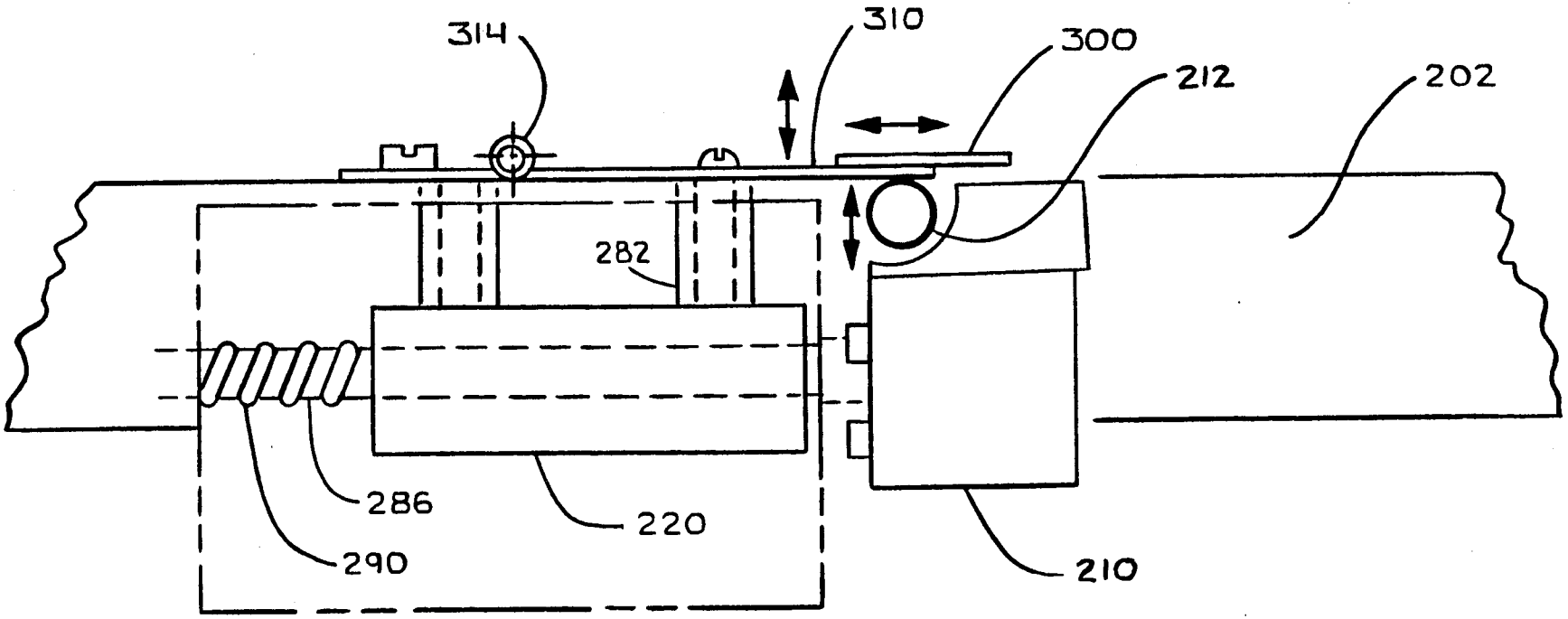

Reference is made to FIGS. 4, 5 and 6 which illustrate a fluid timer 220 the purpose of which is to deactivate the system after a predetermined period of time. The fluid timer 220 includes a cylinder or piston housing 250 attached by a bracket 252 near the top and internal to the work chamber 14 as shown in the left hand portion of FIG. 4. Reciprocatively movable within a cylinder 250 is a piston 254 and piston rod 256. Formed between the piston 254 and cylinder 250 is a timer chamber 260 in fluid communication with a fluid distribution line 262 which may extend from the manifold 54 (shown schematically). A check valve 264 may be connected in the fluid line 262 upstream of the timer chamber 260. Optionally a filter 266 may by installed at a location upsteam of the check valve 264. The piston 254 is biased into the cylinder by a first spring 270 typically installed in the cylinder 250. It should be appreciated that the spring 270 can also be mounted external to the cylinder or piston housing 250. In addition, the spring can be inserted into the left side of the housing 250, in the space referred to as the timer chamber 260, to push the piston 254 out of the housing. In this case the timer chamber would be relocated in the area where the spring 270 is shown in FIG. 4.

The piston 254 is moved outwardly from the piston housing 250 by fluid i.e. cleaning solvent permitted to accumulate in the timer chamber 260. To control the amount of fluid in the timer chamber and thereby the rate of piston travel out of the housing 250, the timer chamber 260 is provided with an outlet orifice 272 (either fixed or variable) having a flow rate lower than the flow rate of fluid into the timer chamber 260. The orifice 272 can be within the timer chamber 260 as shown by phantom lines or externally positioned as shown in FIG. 4. As mentioned above the timer chamber 260 is connected to the manifold 54 which is pressurized by the pump 40. This pump may be a steadily pulsing pump, a contant flow pump or any other pump of sufficient flow capacity. If the flow rate of solvent received from the manifold though the fluid line 262 and into the timer chamber 260 is excessive, a control orifice 274 may be placed in the fluid line 262 or somewhere upstream of the timer chamber to more precisely control the rate of fluid flow into the timer chamber 260. As such it can be seen that the timer chamber is a differential flow rate chamber, the volume of which is defined by the differential in the flow rates of the inlet fluid flow and the outlet flow as established by the outlet orifice 272, control orifice 274 (if used) and pump flow rate. As can be seen by controlling the various flow rates, the rate of movement of the piston and its time of its travel can be controlled.

The fluid timer 220 may further includes a slide assembly generally shown as 280. The slide assembly is preferably attached to the cover 30 as shown in FIGS. 5 and 6. The slide assembly 280 comprises a slider holder 284, fixed to the cover 30 by the brackets 282, into which is reciprocatively mounted a slide bar 286. One end of the slide bar 286, i.e. its push plate 287, is spring loaded by spring 290 toward the piston push plate 292. The other end of the slide bar 286 includes an extension such as a timer plate 300. In the embodiment shown in FIG. 5 the timer plate 300 is bent and extends through an opening 294 in the top side 296 of the cover 32 (which rests on shoulder 28 of the work chamber 14). The timer plate 300 includes a top portion 302 which extends beyond the lip 202 (of the work chamber 14) over the switch element 212 of the cut-off valve 210. As will be described the plate 300, as it moves will selectively engage/disengage the cut-off switch 210 which in turn controls the operation of the pump 40.

The fluid timer 220 may further includes an optional activation element referred to as a depressor assembly 310. The depressor assembly 310 includes a depressor plate 312, hinged at 314 and fastended to the lip 202 of the work chamber at 316. As shown in the drawings the depressor plate 312 engages or rests on the top of the spring element 212 of the cut-off valve 210. When the cover 32 is closed, the timer plate 300 engages the depressor plate 312 depressing the spring element 212 placing the cut-off valve 210 in its activated state. As mentioned above, the depressor plate is optional in that the timer plate 300 acting alone can be used to depress the switch element 212.

The operation of the system is as follows: With the pump 40 off, the cover 30 is opened to permit loading of the articles to be cleaned. With the cover 30 opened the slide bar spring 290 urges the slide bar 286 out of the slider holder 284. This action also moves the timer plate 300 within the opening 294 in the cover 30 to its restart position as shown in FIGS. 4 and 6. In this position, the plate 300, when the cover 30 is replaced, is in proper position to engage the depressor plate 312 (if used) and depress the cut-off switch 210 to its operative condition which will permit compressed air flow therethrough. As can be seen from the figures if the depressor plate 312 were not used the timer plate 300 (portion 302) would be is a position to activate the cut-off valve 210. In this condition the pump 40 is still off since air delivery had been terminated when the cover 30 had been previously raised. During this time any fluid that had accumulated in the timer chamber 260 is permitted to flow therefrom through the outlet orifice 272 into the work chamber 14 thereby relieving fluid pressure in the timer chamber 260. During this time the check valve 264 will prevent the reverse flow of fluid back into the manifold 54. With the fluid pressure relieved in the timer chamber 260 the bias spring 270 urges the piston 254 back into its piston housing 250 to its start position, such position illustrated in FIG. 4. In this condition the system is again ready to operate. Pressurized air is communicated to the air inlet 228 of the reset valve 204, and to the air inlet 230 of the cut-off switch 210, which is now in an operable state, by virtue of its element 212 moved downwardly by the timer plate 300 and depressor 312 (if used) so that air can again communicated back to the reset valve 204 (that is, to the inlet 232). If the reset button/plunger 206 of the reset valve 204 is now depressed pressurized air is communicated to the pump 40. Under the action of the pump 40, cleaning solvent is caused to flow through the many conduits of the work chamber to clean the various articles therein. The pressurized solvent is also communicated to the timer chamber 260 causing the piston 254 to controllably move outwardly (to the left in FIG. 4) therefrom as the timer chamber 260 fills. As mentioned above the rate of fill of the timer chamber 260 and rate and time period of outward motion of the piston is determined by the differential in the input and outlet flow rates of the timer chamber 260. As the piston 254 moves outwardly from its housing 250 the piston 254 engages the push plate 287 of the slide bar 286 and moves the slide bar (to the right in FIGS. 4 or 6). This motion of the slide bar 286 causes the timer plate 300 attached thereto to also move relative to and across the cut-off switch 210 and across the depressor plate 312. After a predetermined time period, determined in part by the size of the timer plate 260 and the length of the depressor plate 312 (if used), the timer plate 300 will have moved to a position in which it is no longer be in contact with the depressor plate 312 or switch element 212 permitting the switch element 212 to release, move upwardly and enter its deactivated state terminating air flow to the reset valve 204. At this point the spool valve 240 (in the reset valve) moves to restrict pressurized air from being communicated to and hence terminating the operation of the pump 40. Fluid cleaning operations can be repeated after the cover 30 has been lifted causing the timer plate 300 to move under the action of its spring 290 to its restart position and by resetting the restart button 206.

Figure 7:
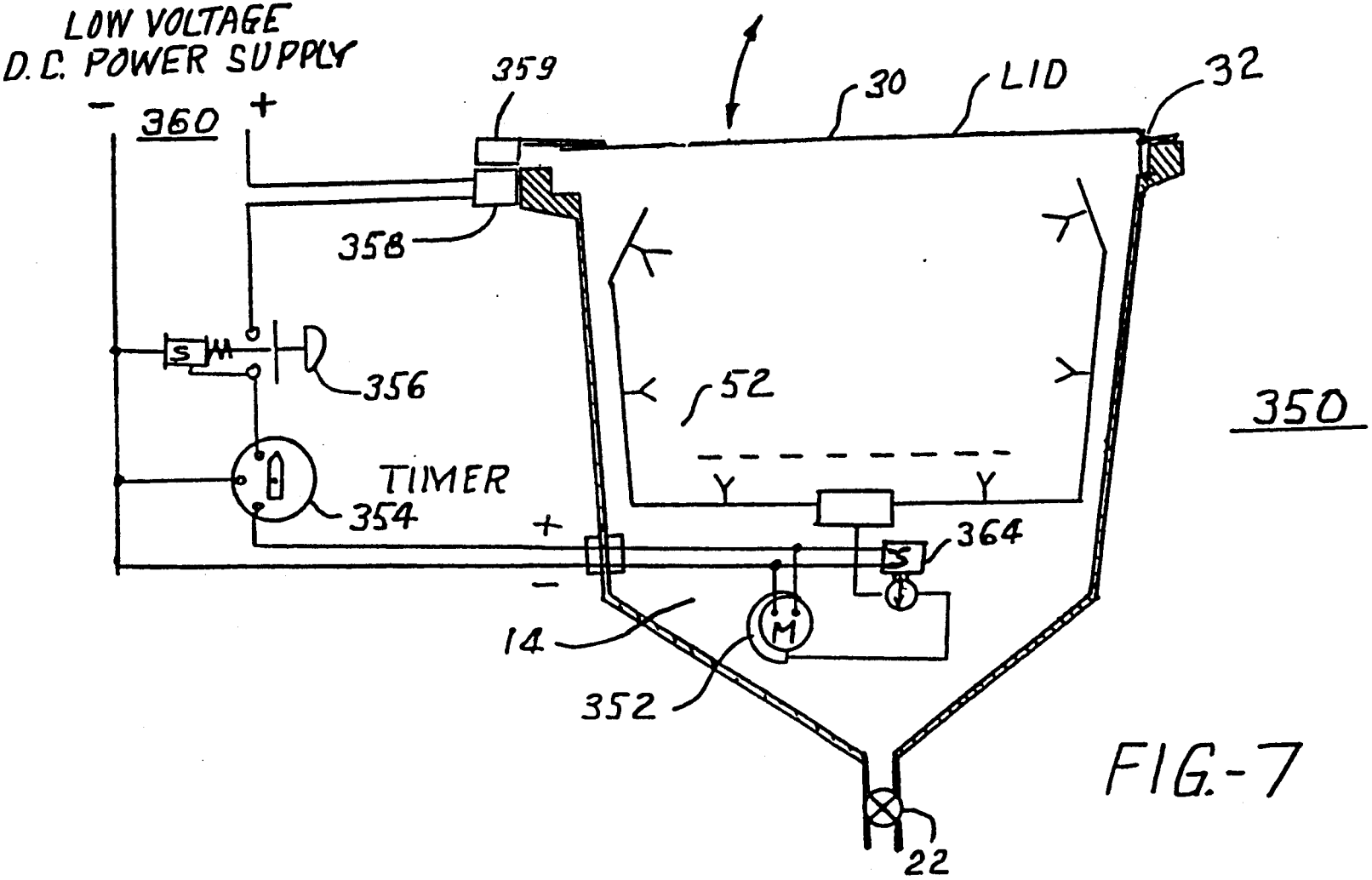
FIGS. 7 through 9 illustrate alternate embodiments of the present invention.

With referenced to FIG. 7, there is shown an alternate embodiment of the present invention. More specifically there is shown an electric timing system 350 for controlling the flow of fluid to a manifold assembly such as 52. Situated within the work chamber 14 and in fluid communication with the manifold assembly 52 is a motor/pump 352 which is activated by an electric timing mechanism 354. The motor/pump 352 may be a submersible device placed in the reservoir 18. The electric timing mechanism is in circuit with and activated by a spring loaded electrical activation switch 356 having a start button 357. To ensure that the motor is operative only upon closure of the cover 30, a proximity switch such as the reed switch 358 is located (typically on the exterior walls of the work chamber 14) to be activated by a magnet 359 mounted to the cover 30 as same is closed thereby applying electrical power from the voltage supply generally shown as 360. An optional solenoid valve 364 may be placed between the motor 352 and the manifold 52.

The operation of this electrically operated timing system 350 is as follows: when the cover 30 is closed the reed switch 358 is activated thereby applying supply voltage to the manual switch 356. Upon depression of the start button 357 the electric timer 354 is activated thereby powering the motor to supply pressurized fluid to the manifold 52. At the end of the fixed timing interval the timing mechanism 354 opens thereby terminating motor and pump operation. To ensure the positive termination of solvent or fluid flow solenoid valve 364 may be activated by the timer mechanism or alternatively by a separate control unit (not shown) thereby positively blocking fluid flow between the motor 352 and manifold 52. When the cover 30 is lifted electric energy flow to the manual start switch 356 is terminated thereby deactivating this switch and the valve 364 and returning the system to its initial state.

Figure 8:
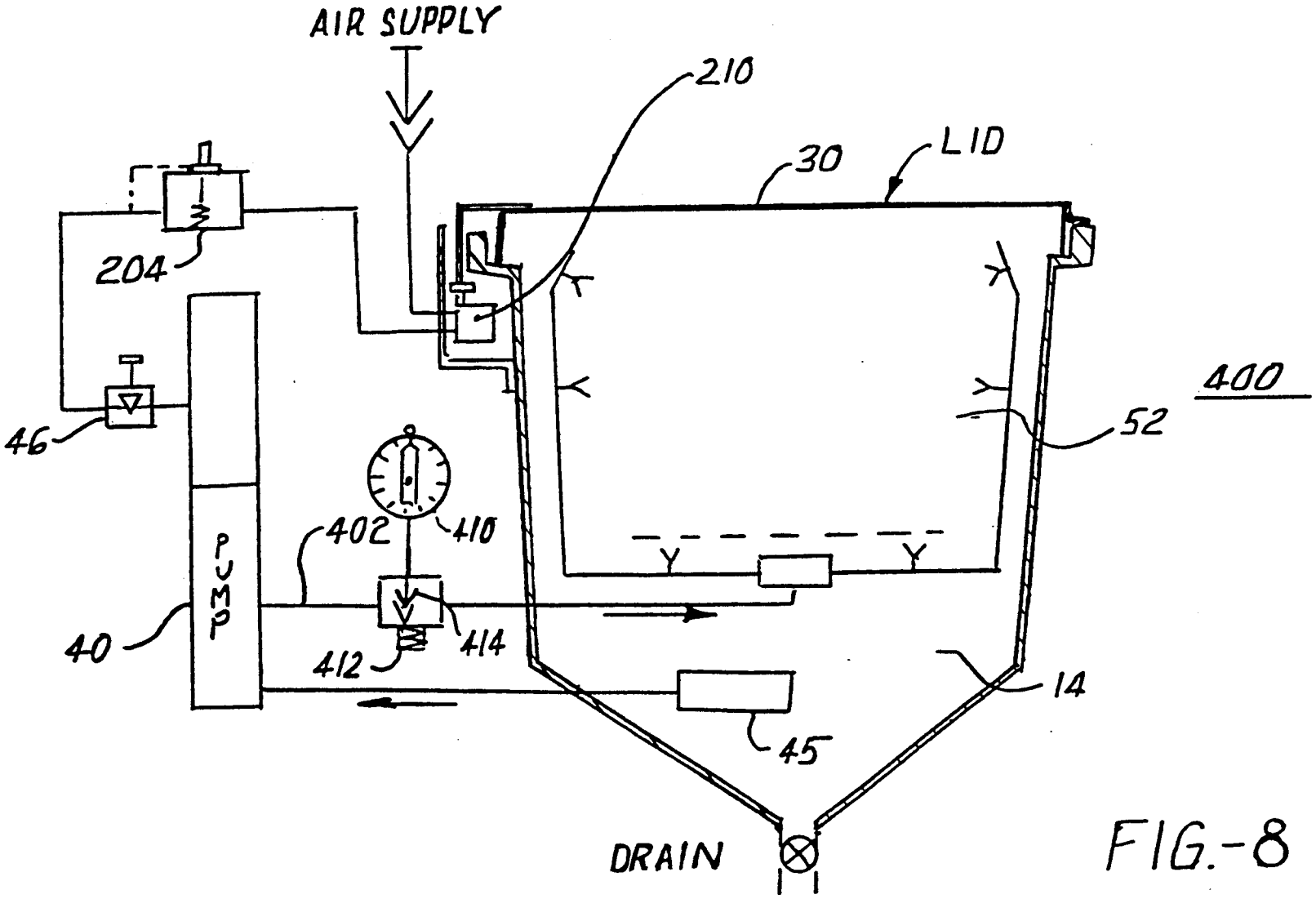

Reference is now made to FIG. 8 which shows a further embodiment of the present invention. There is schematically illustrated a mechanical timing system 400 to control the flow of solvent from the pump 40 to the manifold 52. The arrangement of many of the major components of the system is similar to that shown in FIG. 1. More specifically, the cut-off valve 210 is activated by the cover 30 and is located in series within the air supply line. The cut-off valve 210 controls the flow of air to the reset valve 204, needle valve 46, and air pump 40. Connected between the pump outlet 402 and the manifold 52 is a mechanical timer 410 which may be located either within or without of the work chamber 14. The mechanical timer is normally closed by the pressure of a spring 412. Mechanical timers such as 410 are known in the art and not described herein in detail. The operation of the above system is a follows: air is supplied to the air pump 40 through the cut-off valve 210 which is held open by the cover 30 in its closed position With the mechanical timer 410 set to its desired time, the operator depresses or resets valve 204 to begin operation of the system. After the end of the desired timing interval a plunger 414 associated with the mechanical timer 410 blocks the outlet 402 of the pump thereby dead-heading same and terminating pump 40 operation. Upon opening the cover 30 air supply to the air pump 40 is terminated.

Figure 9:
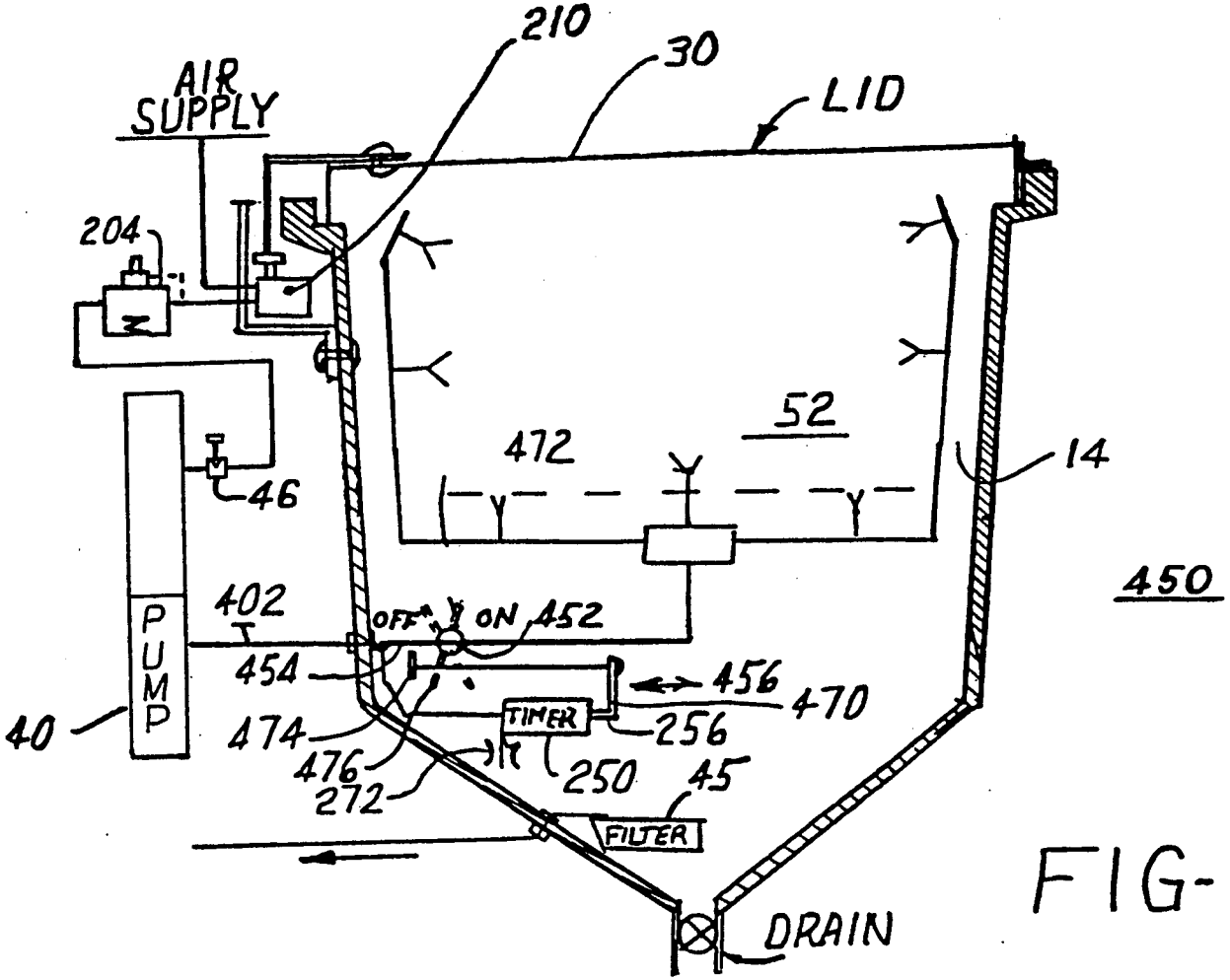

Reference is now made to FIG. 9 which shows an additional embodiment of the present invention. FIG. 9 illustrates a mechanical shut-off system 410 which uses many of the previously described components of the system which are shown with like numerals. Connected to the output 402 of the pump 40 is the piston housing 250 of the fluid timer 220 previously shown in FIG. 4. As described above, the piston 256 will move outwardly from its housing 250 in a timed fashion as fluid enters therein under the influence of pump operation. Also connected to the pump outlet is a mechanical on-off valve 452 having its inlet 454 connected to the pump outlet and having its outlet 456 connected to the manifold 52. The valve 452 is connected to the piston 256 through a linkage member 470 which moves with the piston 256. The valve 452 also includes a manual reset lever shown as 472.

Prior to the operation of the system 450 the operator moves the valve 452 to its on position as shown in FIG. 9. With the air supply connected and the cover 30 closed the operator activates the reset valve 204 which initiates motor and pumping operation. Fluid is thereafter supplied to the manifold 52 through the open valve 452. Fluid is also supplied to the pump chamber 260 (see FIG. 4) filling same and urging the piston 256 outwardly in the manner described above. As the piston rod 256 moves outwardly the linkage 470 moves (to the right as seen in FIG. 9) whereupon a stop 474 engages a portion 476 of the valve 452 thereby causing same to move or rotate to its off position (shown in phantom line in FIG. 9) thereby terminating communication between the pump 40 and manifold 52. Thereafter the piston 256 can continue to move outwardly to its limit. By virtue of the filled timing chamber 260 and the closed valve 452 the pump 40 is dead-headed terminating operation of the system.

Upon lifting the cover 30 the air supply system is reset as described above and the system fully deactivated. Thereafter the piston 256 will automatically reset to its start position as fluid in the timing chamber 260 drains therefrom through the orifice 272. To initiate operation of the system 450 the operator once again manually moves the valve 452 to its on position and repeats the above process.

Figure 10:
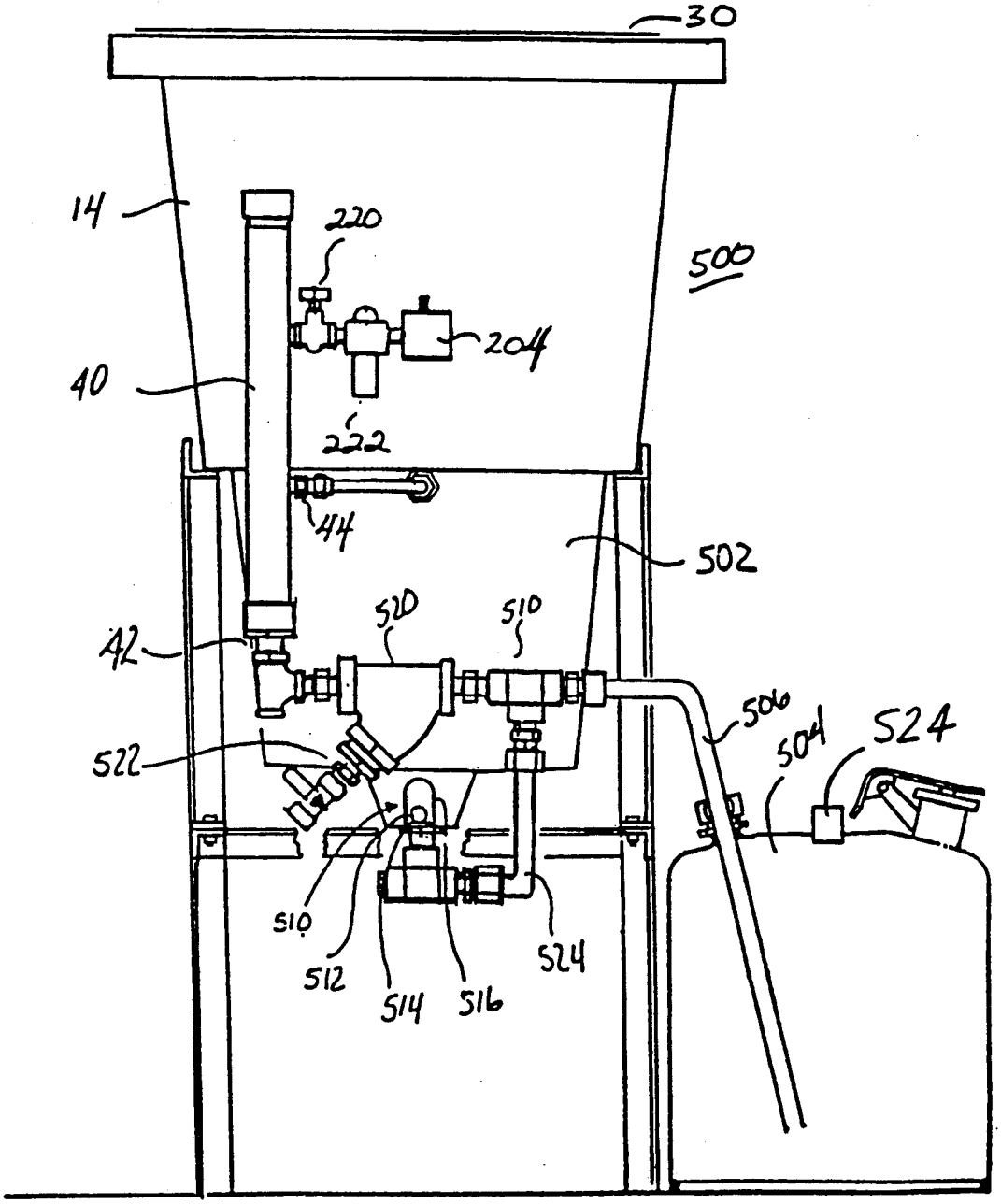
FIGS. 10 and 11 show further alternate embodiments of the present invention.
Figure 11:
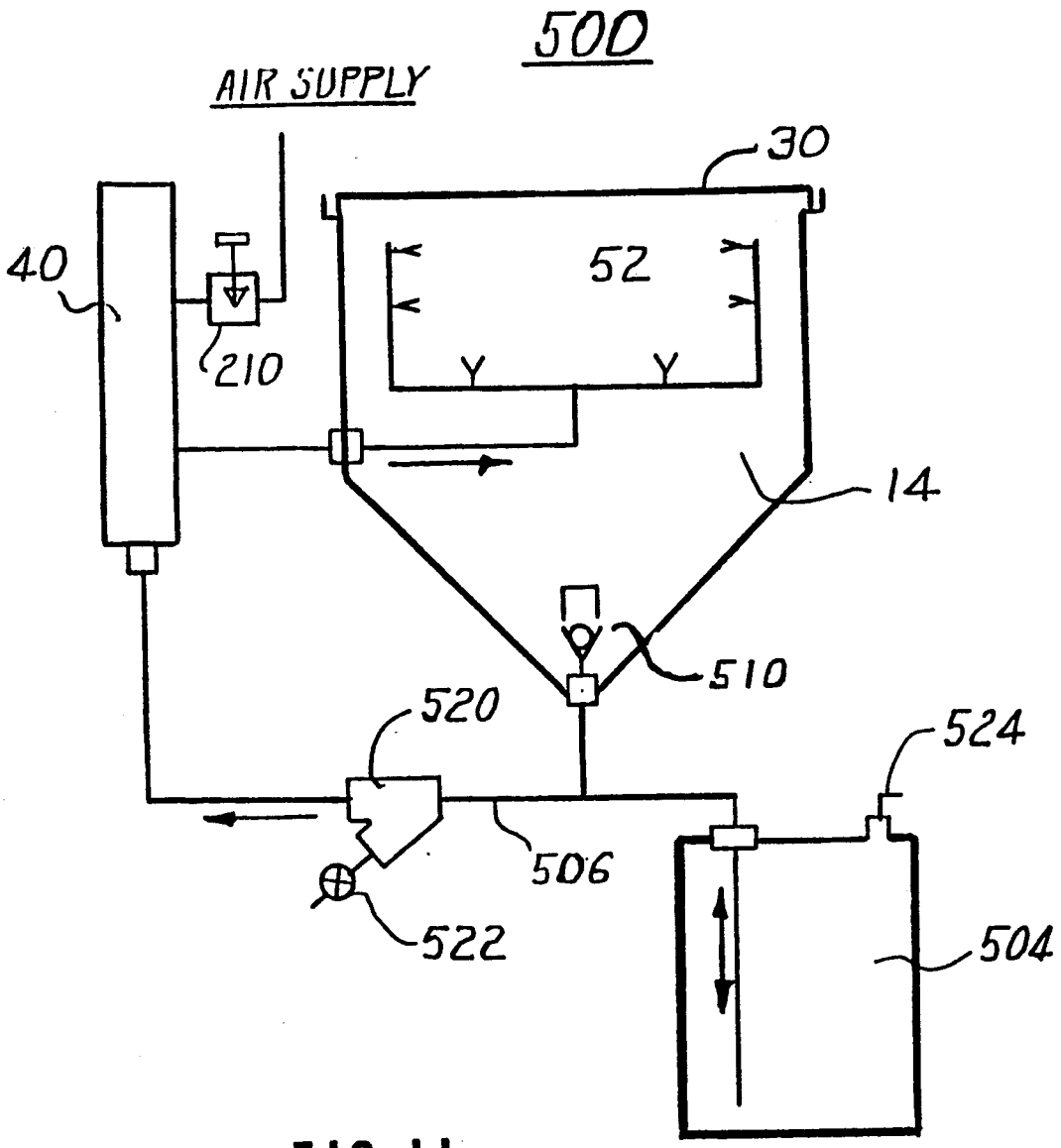

Reference is made to FIG. 10 and 11 which illustrate a further alternate embodiment of the present invention. FIG. 10 illustrates a plan view of a zero reservoir system 500 which incorporates many like components described above. FIG. 11 is a schematic diagram of the system 500. There is shown a work chamber 14 or generally a cabinet 502 in which is located a manifold assembly 52. A pump 40 pressurizes fluid which is communicated to the manifold assembly 52 in the manner described above. While not fully shown in FIGS. 10 and 11 the system 500 includes the air supply system comprising the cut-off valve 210 and reset valve 204. The above described fluid timer 220 can be installed in the same way as described above to interact with the cut-off valve 210. The system 500 is designed to initiate the cleaning cycle with virtually no cleaning solvent or agent in the cabinet 502. Situated in the bottom of the cabinet 502 is a check valve 510 comprising a floating ball 512 which seats upon a valve seat 514. An apertured ball housing 516 is provided to limited or contain the upward motion of the ball 510. The cleaning solvent is contained a safety can 504 adjacent the cabinet or work chamber. With the cut-off valve 210 activated and reset valve 204 active or reset compressed air is supplied to the pump 40. The initial pumping action of the pump 40 removes air from the inlet pipe 506 and creates a vacuum causing solvent resident in the safety can 504 to rise. During this time the ball 512 is seated upon its seat 514. The solvent flows through a T-connection 518, one end of which is connected to the check valve 510, and into a filter 520. The filter 520 is connected to the inlet 42 of the pump 40. The filter 520 may be provided with a drain fitting 522 for the removal of sludge.

The pump 40 supplies fluid or solvent to the manifold assembly 52 to clean an object such as a paint gun 84 mounted thereon. The solvent thereafter falls to the bottom of the cabinet 502. When a sufficient amount of solvent has collected at the bottom of the cabinet or work chamber the check valve 510, which heretofore had been held closed by pump suction or gravity, now opens and allows the solvent to flow or drain through the connecting pipe 524 to the T-connection 510. As can be seen the rate of draining will increase as the amount of solvent in the cabinet increases. When the rate of draining, through the check valve 510, equals the rate of pumping, flow of solvent from the safety can 504 stops and the solvent in the cabinet 502 circulates through the system without the further increase in fluid volume. Upon termination of the cleaning cycle solvent drains into the safety can. With the operation of the pump terminated a syphon action is created between the pressure differential between the pressure of the solvent at the bottom of the cabinet and the pressure of the safety can which is at atmosphere because of an open vent 524 on the can 504. Solvent will flow from the cabinet until the level of solvent in the can is equal to the height of the solvent in the cabinet. When virtually all of the solvent has drained from the cabinet 502, the check valve 510 closes and the system 500 is ready for the next cleaning cycle.

Figure 12:
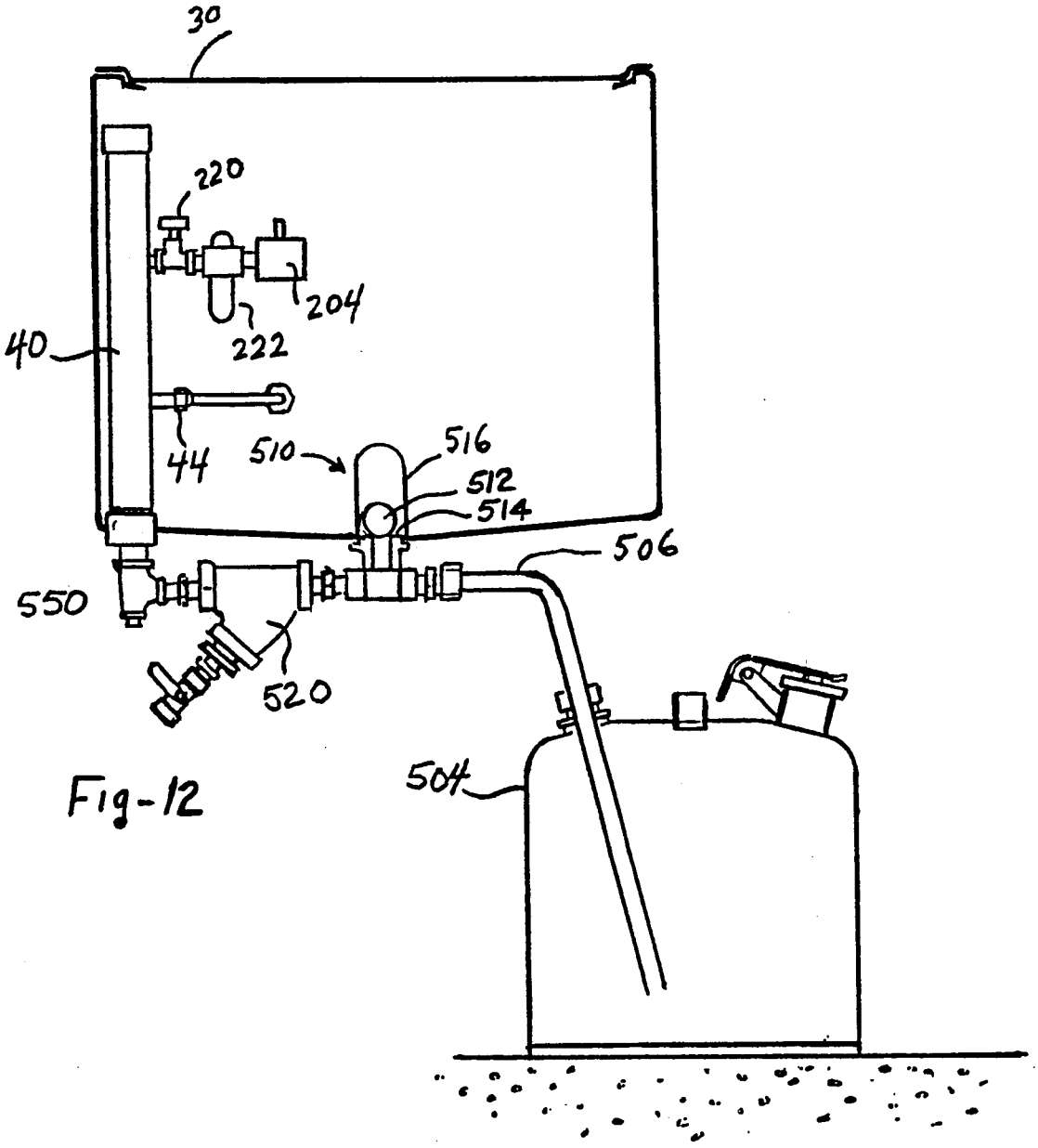
FIGS. 12 through 14 show other embodiments of the invention.
Figure 13:
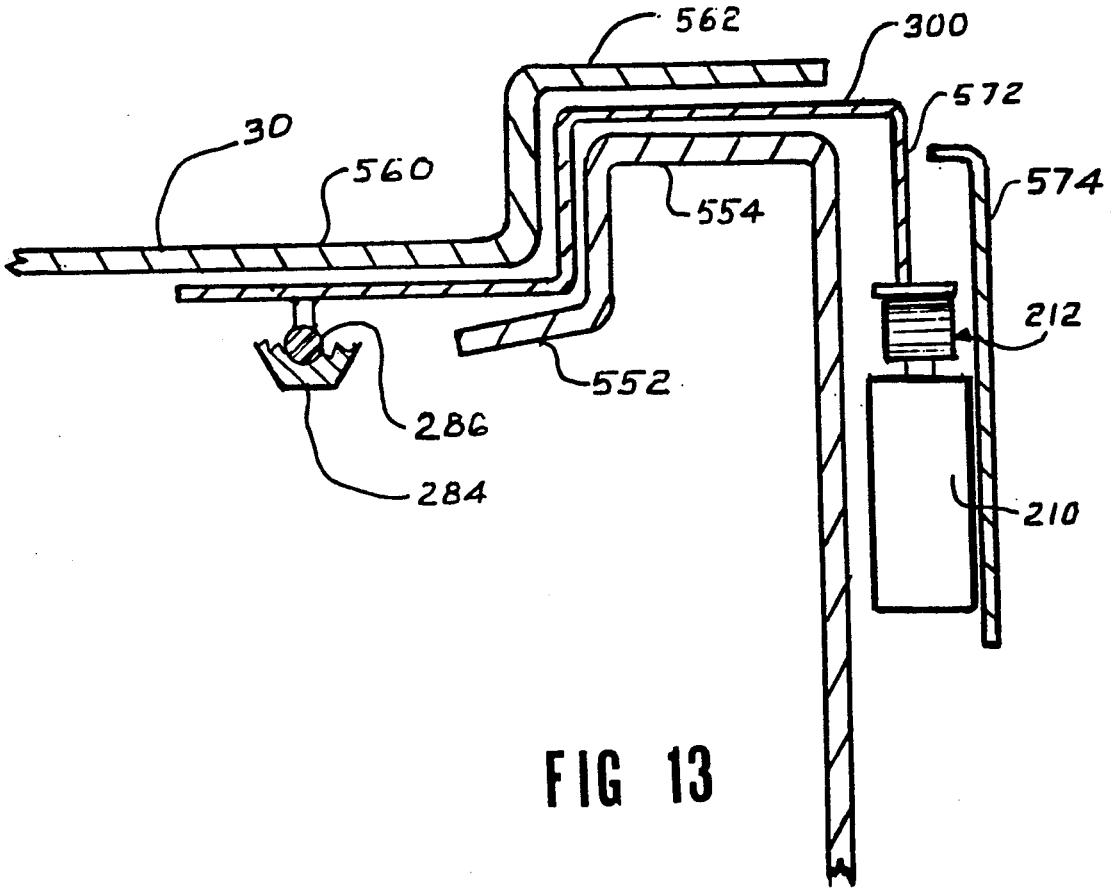
Figure 14:
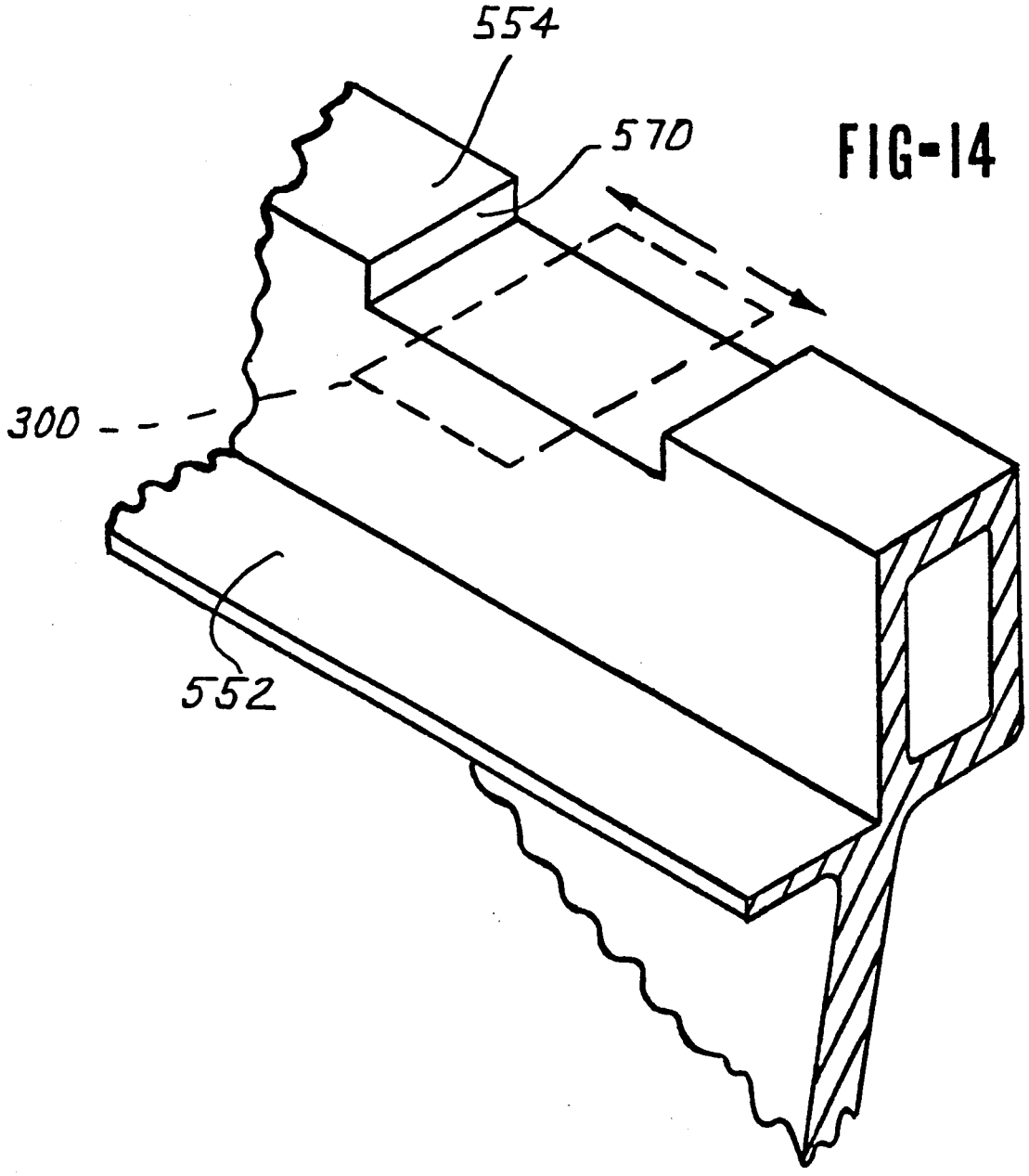

FIG. 12 illustrates another embodiment of the present invention. More specifically, there is shown a system 550 having a more compact cabinet or work chamber 14 connected to a safety can 504. In this embodiment of the invention the check valve 510 is located above the inlet pipe 506. The operation of the system 550 is identical to that of system 500. FIGS. 13 and 14 illustrate additional features of the present invention. Reference is briefly made to FIG. 5. In this figure the timer plate 300 extends through an opening 294 in the cover 30. In addition, the cover 30 rests upon a shoulder 28, which is a portion of the work chamber 14. FIGS. 13 and 14 show an alternate construction of the cover and work chamber 14. More specifically, the top of the work chamber 14 is fabricated to include a double shoulder such as a top shoulder 554 and a lower shoulder 552. These shoulders provide additional sealing of the work chamber by the cover 30. In this embodiment the cover 30 includes a flat portion 560 and a raised lip portion 562. When the cover 30 is closed the flat portion 560 rests upon the lower shoulder 552 and the raised lip portion rests upon the upper shoulder 554. This double seal construction is true for the entire cover/work chamber interface with the exception of the area through which the timer plate 300 extends. As shown, in the exploded view of FIG. 13, the timer plate 300 is positioned below the cover 30. As can be seen the timer plate 300 extends from the slide bar 286 which is housed in the slider holder 284. The slider holder is secured to the underside of the cover 30. To permit the cover to properly seal upon the work chamber 14 the work chamber 14 includes a depression 570, in the upper shoulder 554 into which extends the timer plate 300. The length of the depression 570 is preferably slightly longer than the travel of the timer plate 300. In this embodiment of the invention the timer plate 300 may further include a downward extension 572 to engage the spring element 212 of the cut-off valve 210 or to engage the depressor plate 312 (not shown). A switch guard 574 is provided to prevent tampering with the cut-off valve.

Many changes and modifications in the above described embodiment of the invention can, of course, be carried out without departing from the scope thereof. Accordingly, that scope is intended to be limited only by the scope of the appended claims.

We claim:

1. An apparatus comprising:

a work chamber into which may be placed an object to be cleaned, and a cover to enclose the work chamber;

fluid transport means for carrying cleaning agent to the work chamber, including pump means for pressurizing the cleaning agent;

fluid timer means, in direct communication with the fluid transport means, for interrupting cleaning agent flow after a predetermined interval including a movable piston;

switch means for activating and deactivating the pump means comprising a cut-off valve having an activated and deactivated mode of operation;

wherein the fluid timer means includes slide means, movable by the piston, into contact with the cut-off valve, for causing the cut-off valve to enter its deactivated mode to deactivate the pump means.

2. The apparatus as defined in claim 1 wherein the cleaning agent is one of a caustic fluid, a volatile fluid and a flammable fluid; and wherein the cut-off valve is mounted outside of the work chamber, and wherein the fluid timer means is mounted within the work chamber.

3. The apparatus as defined in claim 1 wherein the fluid timer means comprises:

piston housing including means for defining a timer chamber adapted to receive cleaning agent from the fluid transport means at a first port communicated to the timer chamber, the received cleaning agent acting on only one end of the piston;

output orifice means operatively situated downstream of the first port for controlling the rate at which solvent flows into the timer chamber;

the piston movable in a first direction by the cleaning agent, within the timer chamber, and communicatable with the slide means;

biasing means for urging the piston in a direction opposite to the first direction.

4. The apparatus as defined in claim 1 wherein the fluid timer means includes outlet orifice means in communication with the timer chamber for controlling the rate of fluid buildup within the timer chamber and the rate of piston motion in a first direction.

5. The apparatus as defined in claim 4 wherein the outlet orifice means defines an outlet flow area which is variable.

6. The apparatus as defined in claim 5 wherein the fluid timer means includes a second orifice upstream of the timer chamber.

7. The apparatus as defined in claim 6 wherein a check valve is located upstream of the timer chamber.

8. The apparatus as defined in claim 7 wherein a filter is disposed upstream of the check valve.

9. The apparatus as defined in claim 1 wherein the slide means includes:

a slide holder, and first means including a slide bar reciprocatively movable relative to the slide holder in response to motion imparted thereto by the piston, and engagement means movable relative to the cut-off valve, for dissenging such switch after the determinable period, causing the cut-off valve to move into its deactivated state.

10. The apparatus as defined in claim 9 wherein the first means is biased by a slide spring in a direction opposite from the first direction such that upon disconnection of the piston from the first means the timer plate is moved in the opposite direction to a position sufficient to place the cut-off valve in its activated state when the cover is again closed.

11. The apparatus as defined in claim 9 wherein the first means is mounted on the cover.

12. The apparatus as defined in claim 9 wherein the engagement means includes a timer plate extending beyond the cover for engaging and or disengaging the switch means.

13. The apparatus as defined in claim 9 wherein pressurized cleaning agent is forced into the timer chamber under the action of a pump means causing the timer chamber to fill at a differential flow rate with a portion of the cleaning agent in the timer chamber escaping therefrom through the outlet orifice means, the piston being urged outwardly, in the first direction, as the timer chamber fills causing the slide means to move in the first direction wherein at the predetermined time, the timer chamber has filled to a degree that the piston and slider means have moved sufficiently in the first direction to cause the engagement means to disconnect from the switch means to terminate the operation of the pump means.

14. The apparatus as defined in claim 13 wherein after the operation of the pump means is terminated the pressurized fluid in the timer chamber is caused to flow therefrom through the outlet orifice means permitting the piston to move in the opposite direction under the operation of the biasing means and permitting the slide means to also move in the opposite direction under the action of the bias force of the slide spring toward a position for reengagement with the switch means.

15. The apparatus as defined in claim 14 wherein if the cover is opened such action causes the disconnection of the piston from the slide means permitting the slide means to be urged in the second direction under the action of the bias force of the slide spring which moves the engagement means in the opposite direction sufficiently such that upon closure of the cover the engagement means is an a position to reengage the cut-off valve placing same in its activated state.

16. An apparatus comprising:

a work chamber into which may be placed an object to be cleaned, and a cover to enclose the work chamber;

fluid transport means for carrying cleaning agent to the work chamber, including pump means for pressurizing the cleaning agent;

fluid timer means, in communication with the fluid transport means, for interrupting cleaning agent flow after a predetermined interval;

wherein the pump means is a compressed air responsive pump adapted to be connected in circuit with a source of compressed air, the apparatus further including a reset valve means, connected in series with a cut-off valve and the pump means, for permitting air flow communications to the pump means when the reset valve means is reset.

17. The apparatus as defined in claim 16 wherein the reset valve means includes a housing supporting a spring loaded spool valve and a reset plunger, such that in the absence of air flow from the cut-off valve the spool valve is urged to a closed state prohibiting air flow to the pump means and with air flow from the cut-off valve the spool is movable to a flow or open state upon the activation of the reset plunger whereupon air flow is communicated to the pump means.

18. The apparatus as defined in claim 17 wherein the timer means includes depressor means including a depressor plate interposing the engagement means and the cut-off valve such that the cut-off valve is permitted to move to its deactivated state after the engagement means has disengaged from the depressor plate.

19. The apparatus as defined in claim 18 wherein the depressor plate is hinged to the work chamber and rotatable into contact with the cut-off valve.

20. The apparatus as defined in claim 19 wherein the cleaning period is defined in part by the length of the depressor plate and the time taken for the engagement means to overtravel the depressor plate.

21. The apparatus as defined in claim 16 wherein the housing of the reset valve means includes an inlet port adapted to receive a standard air line fitting to enable connection to an air compressor, a first passage extending from the inlet port, the other end of the first passage is adapted to be connected to an input of the cut-off valve, the housing including a second passage one of which is connected to an outlet of the cut-off valve and the other end in communication with the spool valve, the housing defining a outlet port adapted to receive another standard air line fitting for connecting the reset valve in circuit with the pump means.

22. An apparatus comprising:

a work chamber into which may be placed an object to be cleaned, and a cover to enclose the work chamber;

fluid transport means for carrying cleaning agent to the work chamber, including pump means for pressurizing the cleaning agent;

fluid timer means, in communication with the fluid transport means, for interrupting cleaning agent flow after a predetermined interval, including a piston movable in a housing;

wherein a manually operable on-off valve is connected in circuit with the fluid transport means, downstream of the pump means, and linked to the fluid timer means so that when the piston moves outward from its housing the on-off valve is urged to its off state, the on-off valve being manually resettable to its on state.

23. An apparatus comprising:

a work chamber into which may be placed an object to be cleaned, and a cover to enclose the work chamber;

fluid transport means for carrying cleaning agent to the work chamber, including pump means for pressurizing the cleaning agent, wherein the pump means is powered by an electric motor;

fluid timer means, in communication with the fluid transport means, for interrupting cleaning agent flow after a predetermined interval, wherein the fluid timer means includes an electric timer in circuit with the motor;

wherein a solenoid valve is located downstream of the pump means and responsive to an electric control signal for restricting flow from the pump means to other parts of the fluid transport means.

24. An apparatus comprising:

a work chamber into which may be placed an object to be cleaned, and a cover to enclose the work chamber;

fluid transport means for carrying cleaning agent to the work chamber, including pump means for pressurizing the cleaning agent;

fluid timer means, in communication with the fluid transport means, for interrupting cleaning agent flow after a predetermined interval;

wherein the fluid timer means includes a mechanical timer downstream of the pump means, having a timing period defined by a manual setting thereof, to dead head the pump means after the end of the timing period.

25. An apparatus comprising:

a work chamber into which may be placed an object to be cleaned, and a cover to enclose the work chamber;

fluid transport means for carrying cleaning agent to the work chamber, including pump means for pressurizing the cleaning agent;

fluid timer means, in communication with the fluid transport means, for interrupting cleaning agent flow after a predetermined interval;

including a safety can remote from the work chamber and a check valve located upstream of the safety can, the pump means operative to develop a suction to draw cleaning agent from the safety can through a pipe connected thereto into the work chamber.

26. The apparatus as defined in claim 25 wherein upon termination of the operation of the pump means a syphon action is created to permit cleaning agent in the work chamber to drain into the safety can.

27. The apparatus as defined in claim 25 wherein the check valve is maintained in a closed condition until a predetermined amount of fluid enters the work chamber and thereafter opens to permit the cleaning agent to flow into the pipe and thereafter back into the pump means, wherein at such time that the rate at which cleaning agent drains from the check valve is equal to the rate at which the pump means is pumping agent into the work chamber no additional cleaning solvent is drawn from the safety can therein permitting the amount of cleaning agent in the work chamber to remain constant.

* * * * *